US011107624B2

(12) United States Patent
Shirouzu et al.

(10) Patent No.: US 11,107,624 B2
(45) Date of Patent: Aug. 31, 2021

(54) ELECTROMAGNETIC DEVICE

(71) Applicant: Fanuc Corporation, Yamanashi (JP)

(72) Inventors: Masatomo Shirouzu, Yamanashi (JP); Kenichi Tsukada, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 125 days.

(21) Appl. No.: 16/569,775

(22) Filed: Sep. 13, 2019

(65) Prior Publication Data

US 2020/0005995 A1 Jan. 2, 2020

Related U.S. Application Data

(62) Division of application No. 15/841,842, filed on Dec. 14, 2017, now Pat. No. 10,483,033.

(30) Foreign Application Priority Data

Dec. 22, 2016 (JP) ..... JP2016-249253

(51) Int. Cl.
*H01H 75/00* (2006.01)
*H01F 30/04* (2006.01)
(Continued)

(52) U.S. Cl.
CPC ..... *H01F 30/04* (2013.01); *H01F 27/24* (2013.01); *H01F 27/263* (2013.01); *H01F 27/28* (2013.01);
(Continued)

(58) Field of Classification Search
CPC ..... H01F 30/04; H01F 27/263; H01F 27/28; H01F 27/40; H01F 27/24; H01F 30/12; H01F 37/00; H01F 2027/408; H01F 27/306; H01F 27/36; H01F 27/33; H01F 27/245; H01F 27/02; H01F 27/26; H01F 27/29; H01F 3/14
(Continued)

(56) References Cited

U.S. PATENT DOCUMENTS 564,944 A 7/1896 Sessions
4,912,618 A 3/1990 Krinickas, Jr.
(Continued)

FOREIGN PATENT DOCUMENTS

CN 105761883 A 7/2016
CN 105939068 A 9/2016
(Continued)

OTHER PUBLICATIONS

Entire patent prosecution history of U.S. Appl. No. 15/841,842, filed Dec. 14, 2017, entitled, "Electromagnetic Device.".

*Primary Examiner* — Shawki S Ismail
*Assistant Examiner* — Lisa N Homza
(74) *Attorney, Agent, or Firm* — RatnerPrestia

(57) ABSTRACT

An electromagnetic device includes an outer peripheral iron core, and at least three iron core coils which are in contact with or coupled to the inner surface of the outer peripheral iron core. The at least three iron core coils each include an iron core, and at least one of a primary coil and a secondary coil, which are wound around the iron core. The at least three iron core coils are arranged in a circle, and the iron core of one of the at least three iron core coils is in contact with the iron cores of the other iron core coils adjacent to the one iron core coil.

1 Claim, 13 Drawing Sheets

(51) Int. Cl.

| | |
|---|---|
| ***H01F 27/28*** | (2006.01) |
| ***H01F 27/40*** | (2006.01) |
| ***H01F 27/24*** | (2006.01) |
| ***H01F 27/26*** | (2006.01) |
| *H01F 30/12* | (2006.01) |
| *H01F 37/00* | (2006.01) |

(52) U.S. Cl.
CPC ..... *H01F 27/40* (2013.01); *H01F 30/12* (2013.01); *H01F 37/00* (2013.01); *H01F 2027/408* (2013.01)

(58) Field of Classification Search
USPC ..... 335/12
See application file for complete search history.

(56) References Cited

U.S. PATENT DOCUMENTS

| | | | | |
|---|---|---|---|---|
| 7,796,003 | B2 | 9/2010 | Hashino et al. | |
| 10,008,322 | B2 | 6/2018 | Bhide et al. | |
| 10,250,106 | B2 | 4/2019 | Senoo | |
| 2009/0180305 | A1 | 7/2009 | Hashino et al. | |
| 2009/0261939 | A1 | 10/2009 | Shudarek | |
| 2010/0141059 | A1 | 6/2010 | Nishimura | |
| 2012/0106210 | A1 | 5/2012 | Xu et al. | |
| 2013/0187741 | A1 | 7/2013 | Goodrich et al. | |
| 2014/0001891 | A1 | 1/2014 | Nitta | |
| 2016/0125998 | A1 | 5/2016 | Bhide et al. | |
| 2017/0011842 | A1 | 1/2017 | Ishigaki et al. | |
| 2017/0084377 | A1* | 3/2017 | Maeda | H01F 27/255 |
| 2017/0154718 | A1* | 6/2017 | Maeda | H01F 3/14 |
| 2017/0221628 | A1* | 8/2017 | Shirouzu | H01F 27/324 |
| 2017/0372828 | A1* | 12/2017 | Shirouzu | H01F 27/06 |
| 2018/0025830 | A1* | 1/2018 | Tsukada | H01F 27/245 336/198 |
| 2018/0068776 | A1* | 3/2018 | Maeda | H01F 27/255 |
| 2018/0090262 | A1* | 3/2018 | Tsukada | H01F 27/2828 |
| 2018/0122564 | A1* | 5/2018 | Tsukada | H01F 27/29 |
| 2018/0182522 | A1* | 6/2018 | Shirouzu | H02K 11/02 |
| 2018/0182529 | A1* | 6/2018 | Shirouzu | H01F 27/24 |
| 2018/0182540 | A1* | 6/2018 | Shirouzu | H01F 27/40 |
| 2018/0183280 | A1* | 6/2018 | Shirouzu | H02K 1/04 |
| 2018/0204667 | A1* | 7/2018 | Tsukada | H01F 27/33 |
| 2018/0233265 | A1* | 8/2018 | Tsukada | H01F 27/025 |
| 2018/0233266 | A1* | 8/2018 | Tsukada | H01F 27/306 |
| 2018/0233275 | A1* | 8/2018 | Tsukada | H01F 27/263 |
| 2018/0254135 | A1* | 9/2018 | Tsukada | H01F 37/00 |
| 2018/0261371 | A1* | 9/2018 | Tsukada | H01F 27/085 |
| 2018/0261374 | A1* | 9/2018 | Tsukada | H01F 37/00 |
| 2018/0268984 | A1* | 9/2018 | Shirouzu | H01F 3/10 |
| 2018/0268985 | A1* | 9/2018 | Shirouzu | H01F 27/263 |
| 2018/0268991 | A1* | 9/2018 | Tsukada | H01F 30/12 |
| 2018/0268992 | A1* | 9/2018 | Tsukada | H01F 37/00 |
| 2018/0277295 | A1* | 9/2018 | Shirouzu | H01F 27/245 |
| 2018/0311640 | A1* | 11/2018 | Yoshida | H01F 27/263 |
| 2018/0336984 | A1* | 11/2018 | Yoshida | H01F 27/263 |
| 2018/0350504 | A1* | 12/2018 | Yoshida | H01F 27/306 |
| 2018/0358165 | A1* | 12/2018 | Yoshida | H01F 27/266 |
| 2018/0366252 | A1* | 12/2018 | Yoshida | H01F 27/263 |
| 2018/0366268 | A1* | 12/2018 | Yoshida | H01F 27/245 |
| 2019/0013134 | A1* | 1/2019 | Yoshida | H01F 3/14 |
| 2019/0013135 | A1* | 1/2019 | Shirouzu | H01F 3/14 |
| 2019/0013136 | A1* | 1/2019 | Tsukada | H01F 27/24 |
| 2019/0013137 | A1* | 1/2019 | Shirouzu | H01F 27/306 |
| 2019/0013139 | A1* | 1/2019 | Shirouzu | H01F 27/28 |
| 2019/0019614 | A1* | 1/2019 | Yoshida | H01F 37/00 |
| 2019/0027299 | A1* | 1/2019 | Yoshida | H01F 27/04 |
| 2019/0035529 | A1* | 1/2019 | Yoshida | H01F 27/24 |
| 2019/0035530 | A1* | 1/2019 | Yoshida | H01F 37/00 |
| 2019/0035531 | A1* | 1/2019 | Yoshida | H01F 27/28 |
| 2019/0035537 | A1* | 1/2019 | Yoshida | H01F 27/06 |
| 2019/0035539 | A1* | 1/2019 | Yoshida | H01F 27/245 |
| 2019/0035542 | A1* | 1/2019 | Yoshida | H01R 13/447 |

FOREIGN PATENT DOCUMENTS

| | | | |
|---|---|---|---|
| JP | S49043123 | A | 4/1974 |
| JP | H03502279 | A | 5/1991 |
| JP | 0552650 | B2 | 8/1993 |
| JP | 2001119874 | A | 4/2001 |
| JP | 2008177500 | A | 7/2008 |
| JP | 2009170620 | A | 7/2009 |
| JP | 2009194957 | A | 8/2009 |
| JP | 2010252539 | A | 11/2010 |
| JP | 4646327 | B2 | 3/2011 |
| JP | 201342028 | A | 2/2013 |
| JP | 2013074084 | A | 4/2013 |
| JP | 5701120 | B2 | 4/2015 |
| JP | 2015159657 | A | 9/2015 |
| JP | 2016122830 | A | 7/2016 |
| JP | 2017059805 | A | 3/2017 |
| WO | 2010119324 | A2 | 10/2010 |
| WO | 2015125416 | A1 | 8/2015 |
| WO | 2015142354 | A1 | 9/2015 |

* cited by examiner

ELECTROMAGNETIC DEVICE

CROSS-REFERENCE TO RELATED APPLICATIONS

This application is a divisional application of U.S. patent application Ser. No. 15/841,842, filed Dec. 14, 2017, which claims priority to Japanese Patent Application No. 2016-249253, filed Dec. 22, 2016, the contents of such application being incorporated by reference herein.

BACKGROUND OF THE INVENTION

1. Field of the Invention

The present invention relates to an electromagnetic device, e.g., a three-phase transformer, a single-phase transformer, etc.

2. Description of the Related Art

Conventional transformers include U-shaped or E-shaped iron cores, and coils wound around such iron cores. The coils are exposed to the outside of the transformer, and a magnetic flux leaking from the coils generates an eddy current at a metal portion in the vicinity of the coils. This causes a problem in which the metal portion of the transformer produces heat. In, specifically, an oil-filled transformer, the transformer is contained in a metal storage container, and accordingly, it is necessary to prevent heat from occurring in the metal storage container by the magnetic flux leaking from the coils.

In order to solve such a problem, in Japanese Examined Patent Publication (Kokoku) No. 5-52650, a shield plate is disposed around the coil, and, in Japanese Patent No. 5701120, a shield plate is bonded to the inside of a storage container. This prevents the metal portion in the vicinity of the coil or the storage container from generating heat.

In conventional three-phase transformers including E-shaped iron cores, the magnetic path length of a central phase is different from the magnetic path length of both end phases. Thus, it is necessary to adjust the balance of the three phases by making a difference between the number of turns in the central phase and the number of turns in both end phases.

In this respect, Japanese Patent No. 4646327 and Japanese Unexamined Patent Publication (Kokai) No. 2013-42028 disclose a three-phase electromagnetic device provided with main windings wound around a plurality of radially arranged magnetic cores, and control windings wound around a magnetic core connecting the plurality of magnetic cores. In such a case, the balance of the three phases can be adjusted.

SUMMARY OF THE INVENTION

However, in Japanese Patent No. 4646327 and Japanese Unexamined Patent Publication (Kokai) No. 2013-42028, the control windings are located at the outermost portion of the electromagnetic device, and accordingly, the magnetic flux of the control windings may leak to the outside. Further, it is necessary to provide the control winding in addition to the main windings, and accordingly, the size of the electromagnetic device may be increased.

The present invention was made in light of the circumstances described above and has an object to provide an electromagnetic device, e.g., a transformer, which prevents magnetic flux from leaking to the periphery and which is not increased in size.

In order to achieve the object, according to a first aspect of the invention, there is provided an electromagnetic device including an outer peripheral iron core, and at least three iron core coils which are in contact with or coupled to the inner surface of the outer peripheral iron core. The at least three iron core coils each include an iron core, and at least one of a primary coil and a secondary coil, which are wound around the iron core. The at least three iron core coils are arranged in a circle, and the iron core of one of the at least three iron core coils is in contact with the iron cores of the other iron core coils adjacent to the one iron core coil.

In the first aspect of the invention, the iron core coils are disposed inside the outer peripheral iron core, and accordingly, the leakage flux from the coils to the periphery can be reduced without providing a shield plate. Further, in a three-phase electromagnetic device, the magnetic path lengths of the three phases are structurally equal, and accordingly, the design and production can be easily performed. Further, when the electromagnetic device is used as a transformer, the ratio of the primary input voltage to the secondary output voltage is fixed, and accordingly, a control winding is not necessary. Thus, an increase in the size of the electromagnetic device can be avoided.

These objects, features, and advantages of the present invention and other objects, features, and advantages will become further clear from the detailed description of typical embodiments illustrated in the appended drawings.

DETAILED DESCRIPTION

Figure 1:
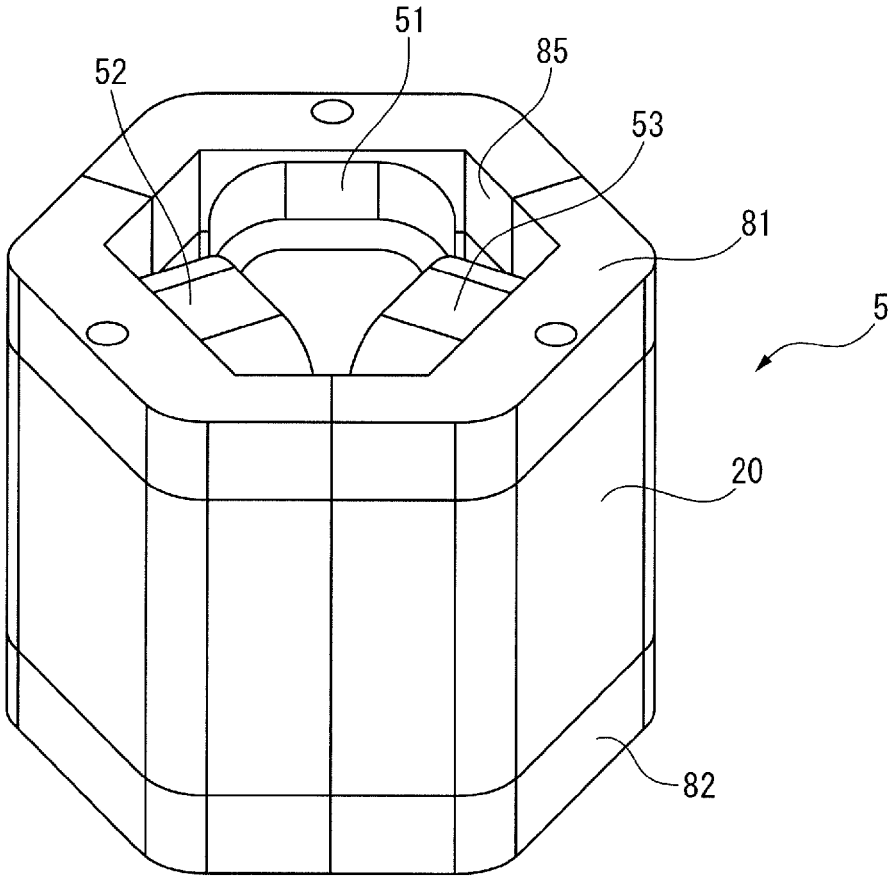
FIG. 1 is a perspective view of an electromagnetic device based on a first embodiment of the present invention.

Embodiments of the present invention will be described below with reference to the accompanying drawings. In the following figures, similar members are designated with the same reference numerals. These figures are properly modified in scale to assist the understanding thereof.

Figure 2A:
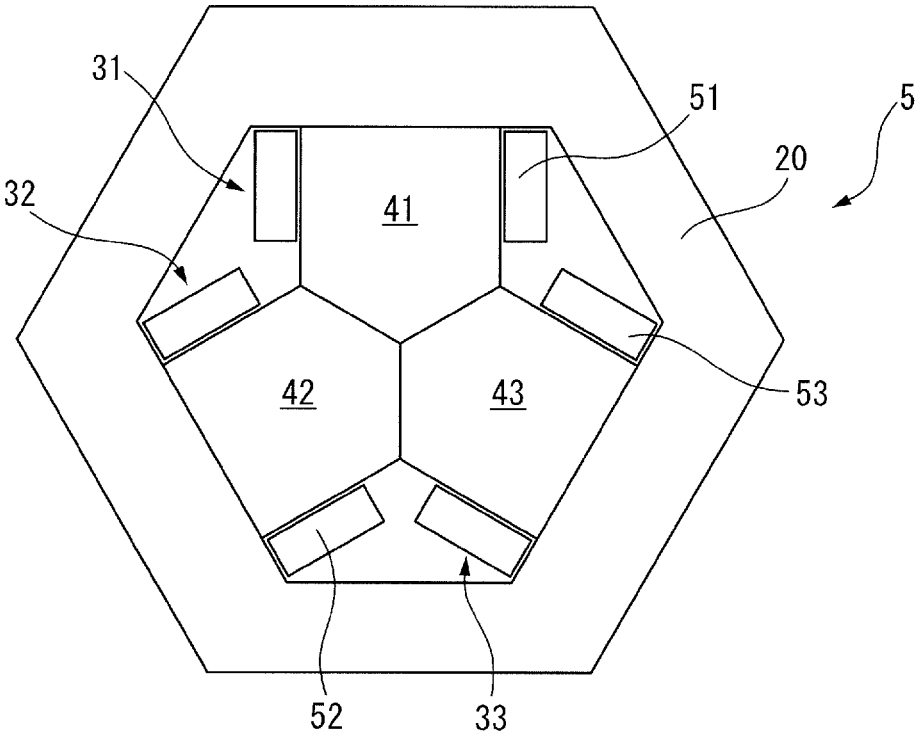
FIG. 2A is a sectional view of the electromagnetic device shown in FIG. 1.

FIG. 1 is a perspective view of an electromagnetic device based on a first embodiment of the present invention. Further, FIG. 2A is a sectional view of the electromagnetic device shown in FIG. 1. As shown in FIG. 1 and FIG. 2A, an electromagnetic device 5, e.g., a transformer or a reactor, includes an outer peripheral iron core 20 having a hexagonal section, and at least three iron core coils 31 to 33 which are in contact with or are coupled to the inner surface of the outer peripheral iron core 20. Note that the outer peripheral iron core 20 may have a circular shape or another polygonal shape.

The iron core coils 31 to 33 respectively include iron cores 41 to 43, and coils 51 to 53 wound around the iron cores 41 to 43. Note that each of the coils 51 to 53 shown in FIGS. 1 and 2A, etc., can include both a primary coil and a secondary coil. The primary coil and the secondary coil may be wound around the same iron core so as to overlap one another, or may be alternately wound around the same iron core. Alternatively, the primary coil and the secondary coil may be wound around separate iron cores. Further, note that the outer peripheral iron core 20 and the iron cores 41 to 43 are made by stacking a plurality of iron plates, carbon steel plates, or magnetic steel plates, or are made of a dust core.

As is clear from FIG. 2A, the iron cores 41 to 43 have the same dimensions, and are spaced at equal intervals in the circumferential direction of the outer peripheral iron core 20. In FIG. 2A, the radially outside ends of the iron cores 41 to 43 are in contact with the outer peripheral iron core 20.

Further, in FIG. 2A, etc., the radially inside ends of the iron cores 41 to 43 converge on the center of the outer peripheral iron core 20, and the tip angle of each end is approximately 120 degrees. As is clear from FIG. 2A, the radially inside ends of the iron cores 41 to 43 are in contact with one another. Thus, there is no gap between the radially inside ends of the adjacent iron cores 41 to 43. Note that, in a not-illustrated embodiment, the radially inside ends of at least two iron cores may be adjacent to each other.

As seen above, in the present invention, the iron core coils 31 to 33 are disposed inside the outer peripheral iron core 20. In other words, the iron core coils 31 to 33 are surrounded by the outer peripheral iron core 20. Thus, the magnetic flux leaking from the coils 51 to 53 to the outside of the outer peripheral iron core 20 can be reduced. In this instance, a conventional shield plate is not necessary, and the production cost can be reduced.

Further, the electromagnetic device 5 shown in FIG. 1, etc., can be used as a three-phase electromagnetic device. In this instance, the magnetic path lengths of the three phases are structurally equal, and accordingly, design and production can be easily performed. Further, when the electromagnetic device 5 shown in FIG. 1, etc., is used as a transformer, the ratio of primary input voltage to secondary output voltage is fixed, and accordingly, conventional control windings are not necessary. Thus, an increase in the size of the electromagnetic device 5 can be avoided.

Figure 2B:
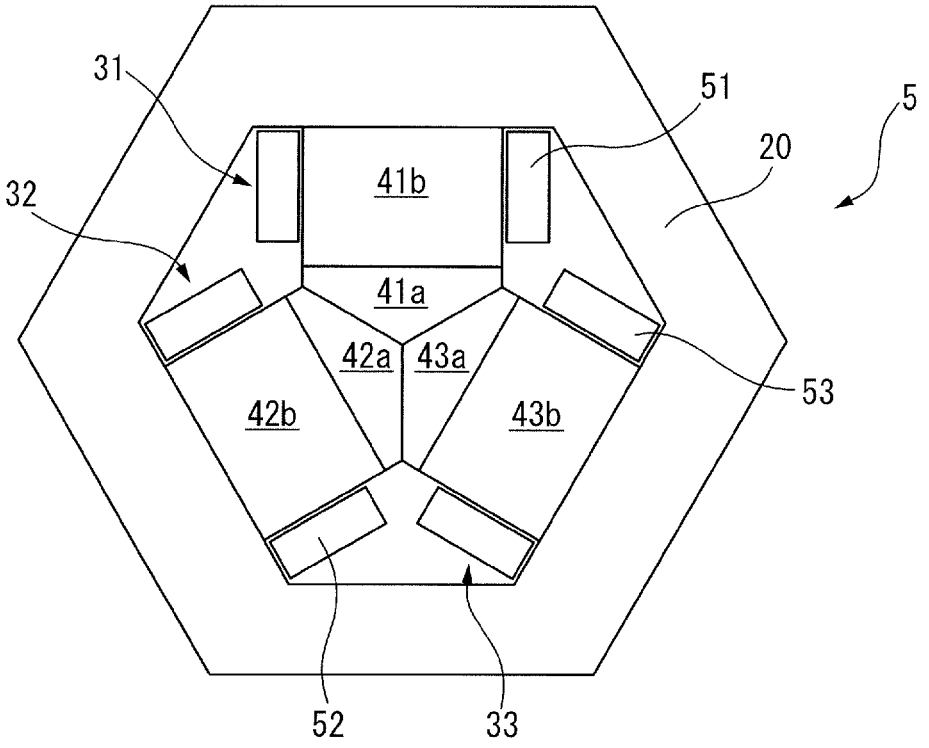
FIG. 2B is a sectional view of an electromagnetic device in a second embodiment.

Further, FIG. 2B is a sectional view of an electromagnetic device in a second embodiment. In FIG. 2B, the iron cores 41 to 43 are respectively comprised of tip side iron core portions 41*a* to 43*a* and base end side iron core portions 41*b* to 43*b*.

In this instance, in a state where only the base end side iron core portions 41*b* to 43*b* are attached to the outer peripheral iron core 20, the coils 51 to 53 are wound around the base end side iron core portions 41*b* to 43*b*. Subsequently, the tip side iron core portions 41*a* to 43*a* are inserted as illustrated.

It will be understood that this causes the coils 51 to 53 to be easily attached, and improves the assembly property. For this object, it is preferable that the coils 51 to 53 not be disposed in areas between the tip side iron core portions 41*a* to 43*a* and the base end side iron core portions 41*b* to 43*b*. Alternatively, each of the iron cores 41 to 43 may be formed from three or more iron core portions.

Note that it is preferable that the contact surfaces between the tip side iron core portions 41*a* to 43*a* and the base end side iron core portions 41*b* to 43*b*, and the contact surfaces between the base end side iron core portions 41*b* to 43*b* and the outer peripheral iron core 20 be finished by mirror finishing, or have a fitting structure. This prevents gaps from being formed between the tip side iron core portions 41*a* to 43*a* and the base end side iron core portions 41*b* to 43*b* and between the base end side iron core portions 41*b* to 43*b* and the outer peripheral iron core 20.

Figure 3A:
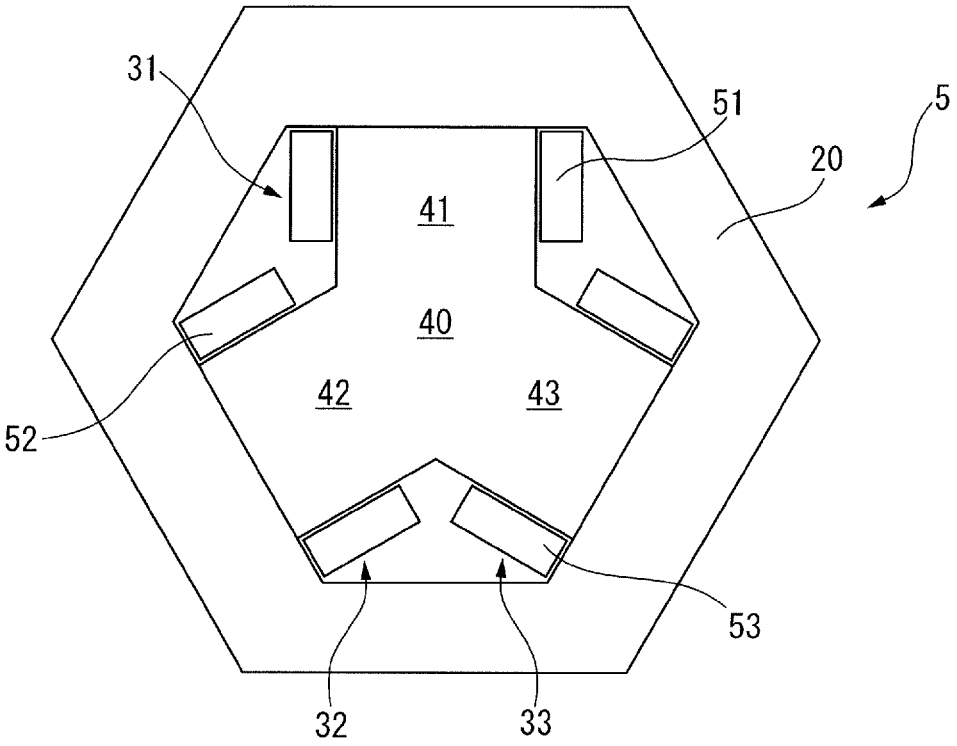
FIG. 3A is a sectional view of an electromagnetic device in a third embodiment.

FIG. 3A is a sectional view of an electromagnetic device in a third embodiment. In FIG. 3A, the iron cores 41 to 43 shown in FIG. 2A are integrally formed as a single iron core 40. In other words, the iron core 40 shown in FIG. 3A cannot be divided into three iron cores 41 to 43. The legs of the iron core 40 in FIG. 3A correspond to the iron cores 41 to 43. The electromagnetic device 5 shown in FIG. 3A includes only the outer peripheral iron core 20 and the iron core 40.

In this instance, the coils 51 to 53 are wound around the three legs of the iron core 40. Subsequently, the electromagnetic device 5 is made by inserting the iron core 40 into the outer peripheral iron core 20. Thus, the number of iron cores 40 can be set to only one, and accordingly, it will be understood that the number of components can be reduced, and consequently, the assembly property can be improved.

Figure 3B:
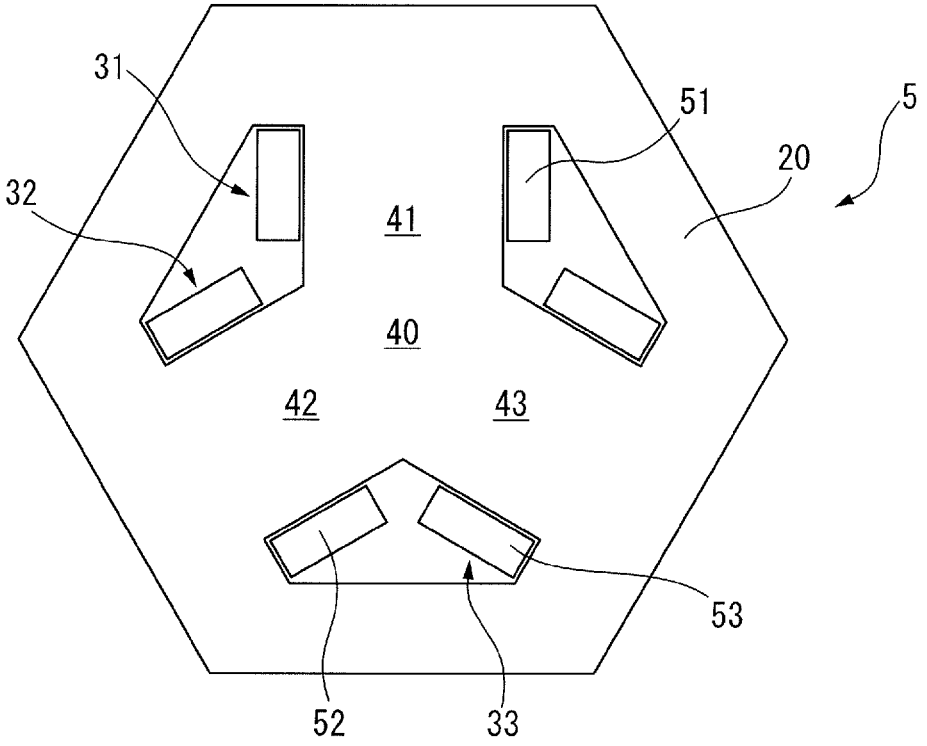
FIG. 3B is a sectional view of another electromagnetic device in the third embodiment.

FIG. 3B is a sectional view of another electromagnetic device in the third embodiment. In this instance, the iron core 40 itself is integral with the outer peripheral iron core 20. The electromagnetic device 5 shown in FIG. 3B includes only a single iron core corresponding to the outer peripheral iron core 20 and the iron core 40. In this instance, it will be understood that the number of components can be further reduced.

Figure 3C:
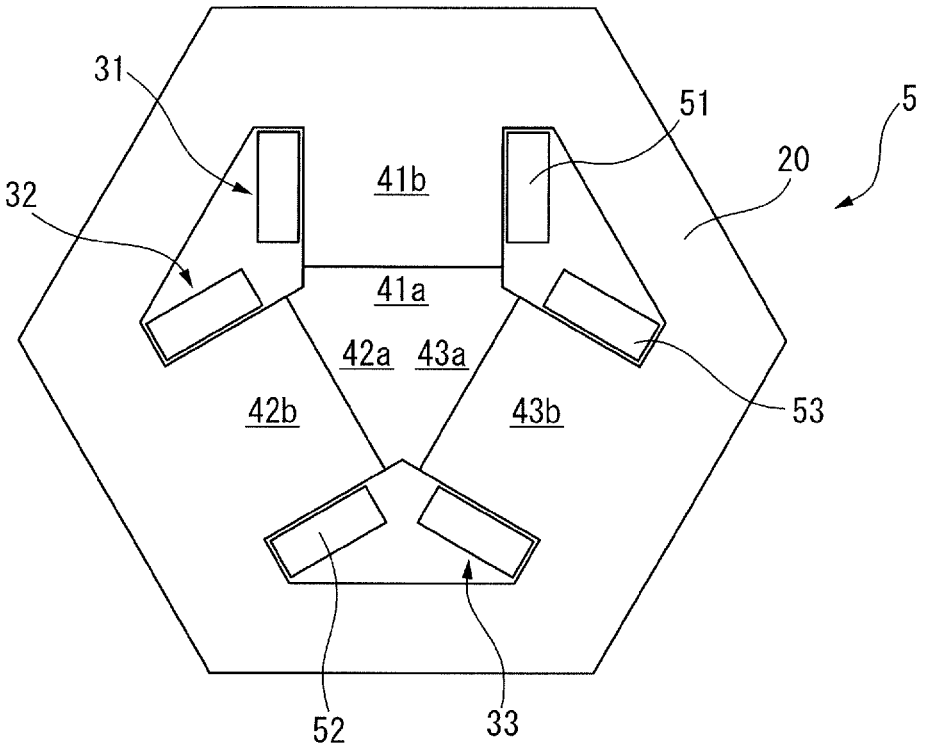
FIG. 3C is a sectional view of still another electromagnetic device in the third embodiment.

Further, FIG. 3C is a sectional view of still another electromagnetic device in the third embodiment. In FIG. 3C, the base end side iron core portions 41*b* to 43*b* are integral with the outer peripheral iron core 20. Further, the tip side iron core portions 41*a* to 43*a* are integral with one another. In other words, the electromagnetic device 5 shown in FIG. 3C includes only a single outer iron core corresponding to the base end side iron core portions 41*b* to 43*b* and the outer peripheral iron core 20, and a single inner iron core corresponding to the tip side iron core portions 41*a* to 43*a*. It will be understood that, even in this instance, an effect similar to the aforementioned effect can be obtained.

Figure 4A:
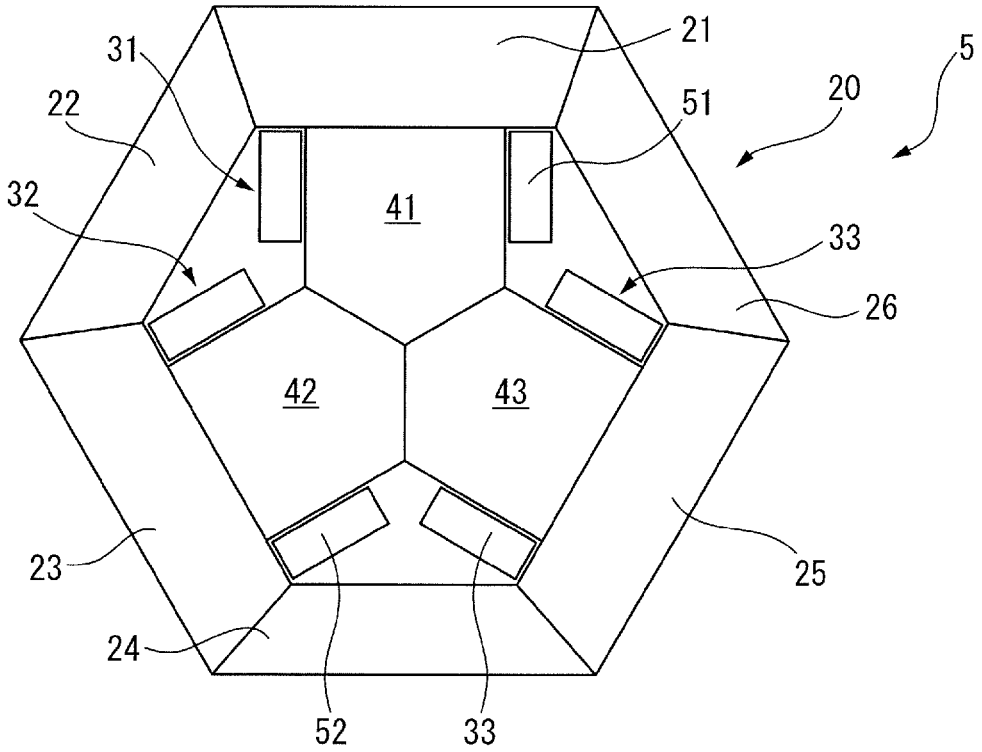
FIG. 4A is a sectional view of an electromagnetic device based on the third embodiment of the present invention.

FIG. 4A is a sectional view of an electromagnetic device based on the third embodiment of the present invention. The electromagnetic device 5 shown in FIG. 4A is similar to the electromagnetic device which has been described with reference to FIG. 2A. However, the outer peripheral iron core 20 of the electromagnetic device 5 shown in FIG. 4A is comprised of a plurality of, e.g., six outer peripheral iron core portions 21 to 26.

In such a case, for example, after the coils 51 to 53 are respectively wound around the iron cores 41 to 43, the outer peripheral iron core portions 21 to 26 are arranged around the iron cores 41 to 43, whereby the electromagnetic device 5 can be assembled. In other words, this method causes the coils 51 to 53 to be easily attached, and accordingly, is advantageous for making, specifically, a large electromagnetic device, e.g., a large transformer. Of course, other methods can be used to assemble the electromagnetic device 5.

The cross-sectional surface of the electromagnetic device 5 shown in FIG. 4A has a hexagonal shape, and the outer peripheral iron core portions 21 to 26 correspond to the sides of the hexagonal shape. However, the shape and number of outer peripheral iron core portions 21 to 26 may be different from those of FIG. 4A.

Figure 4B:
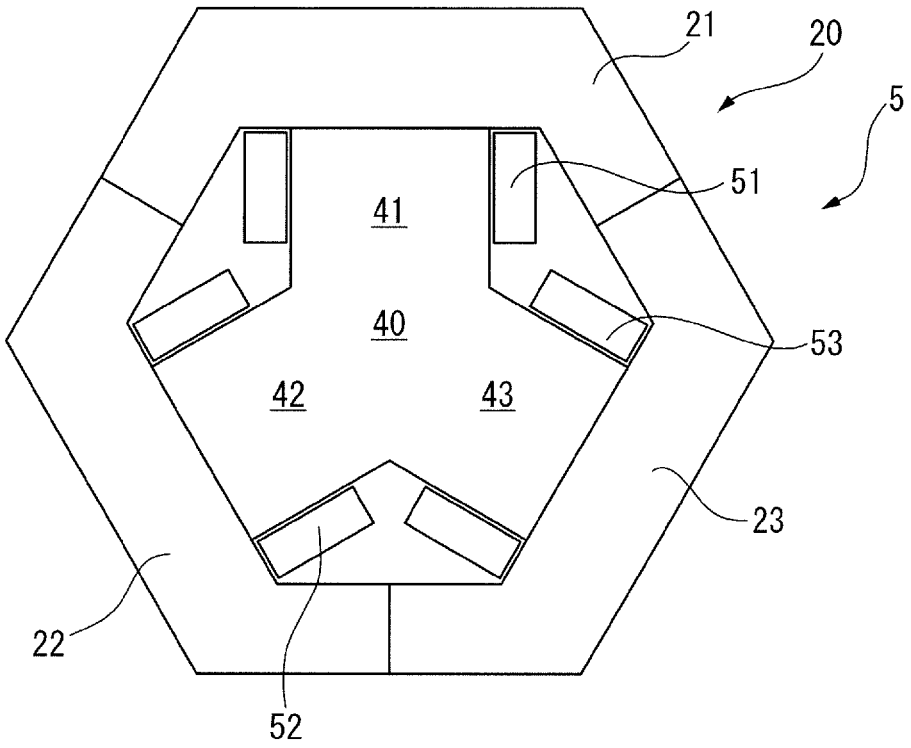
FIG. 4B is a sectional view of another electromagnetic device based on the third embodiment of the present invention.

As shown in FIG. 4B, etc., the outer peripheral iron core 20 may be comprised of three outer peripheral iron core portions 21 to 23. In FIG. 4B, the iron cores 41 to 43 are respectively positioned at the centers of the inner peripheral surfaces of the outer peripheral iron core portions 21 to 23. However, the iron cores 41 to 43 may respectively be positioned at locations other than the centers of the inner peripheral surfaces of the outer peripheral iron core portions 21 to 23.

Figure 4C:
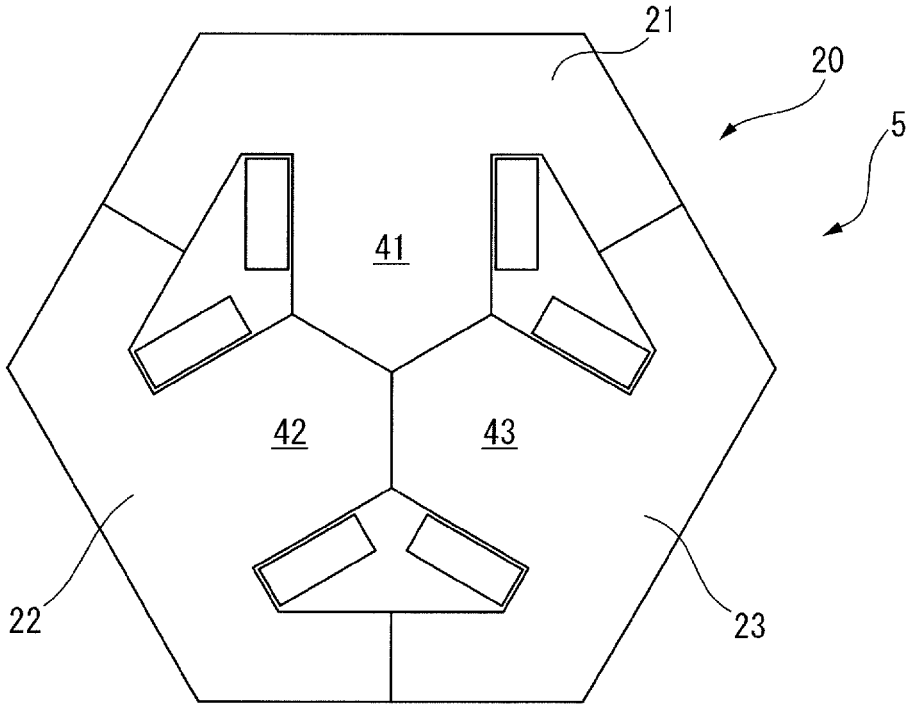
FIG. 4C is a sectional view of still another electromagnetic device based on the third embodiment of the present invention.

Further, as shown in FIG. 4C, the outer peripheral iron core portions 21 to 23 may respectively be integral with the iron cores 41 to 43. It will be obvious that, even in the configurations shown in FIG. 4B and FIG. 4C, an effect similar to the aforementioned effect can be obtained.

Figure 4D:
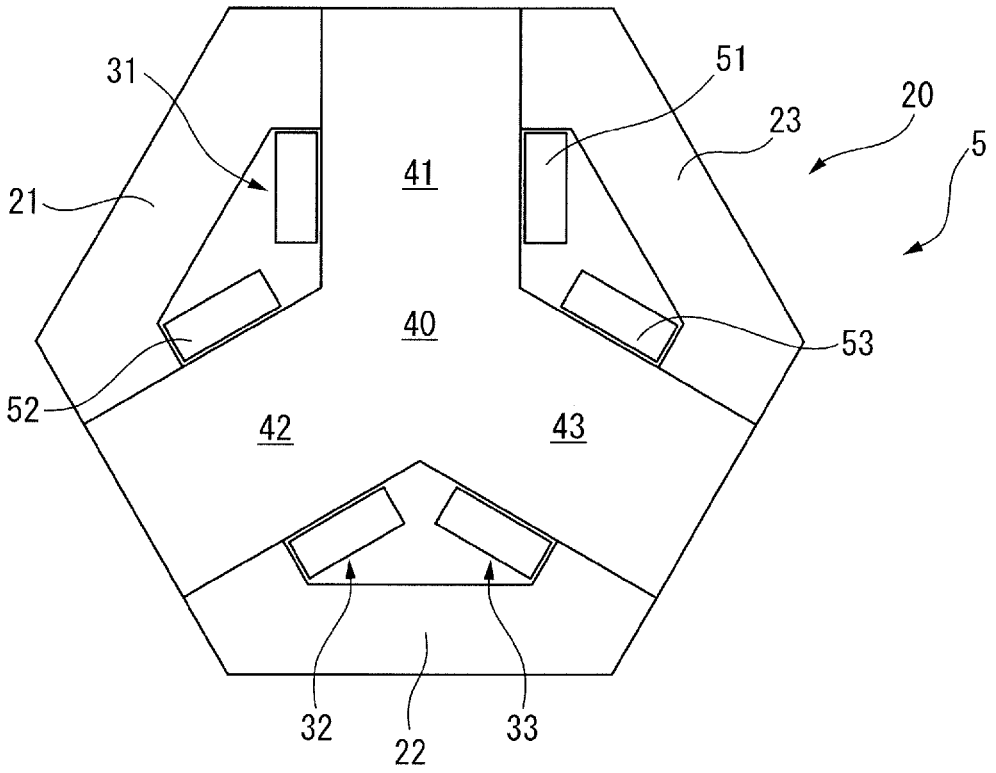
FIG. 4D is a sectional view of still another electromagnetic device based on the third embodiment of the present invention.

Further, in the electromagnetic device 5 shown in FIG. 4D, the radially outside ends of the iron cores 41 to 43 extend to the outer peripheral surface of the electromagnetic device 5. In other words, in FIG. 4D, the radially outside ends of the iron cores 41 to 43 are inserted among the outer peripheral iron core portions 21 to 23.

Even in FIG. 4D, an effect similar to the aforementioned effect can be obtained. Further, in FIG. 4D, the electromagnetic device 5 can be made by attaching the outer peripheral iron core portions 21 to 23 to both side faces of the iron cores 41 to 43 to which the coils 51 to 53 are attached. Thus, it will be understood that the electromagnetic device 5 can be more easily made than the electromagnetic devices shown in FIG. 4A, etc.

Referring again to FIG. 1, the coils 51 to 53 project outward from an end face of the outer peripheral iron core 20. In the present invention, barrier parts 81 and 82 are attached to both axial ends of the outer peripheral iron core 20. The barrier parts 81 and 82 have a shape substantially corresponding to that of the outer peripheral iron core 20, and have an opening 85. Further, it is preferable that the barrier parts 81 and 82 be formed from a magnetic body. The barrier parts 81 and 82 may be formed by a method similar to that for the outer peripheral iron core 20, etc.

When the electromagnetic device 5 is driven, a magnetic flux leaks from the protruding portions of the coils 51 to 53. However, in the present invention, the thickness of the barrier parts 81 and 82 is larger than the protruding portions of the coils 51 to 53. Thus, even if a magnetic flux leaks from the coils 51 to 53, such a magnetic flux can be prevented from leaking to the outside of the electromagnetic device 5.

Figure 5:
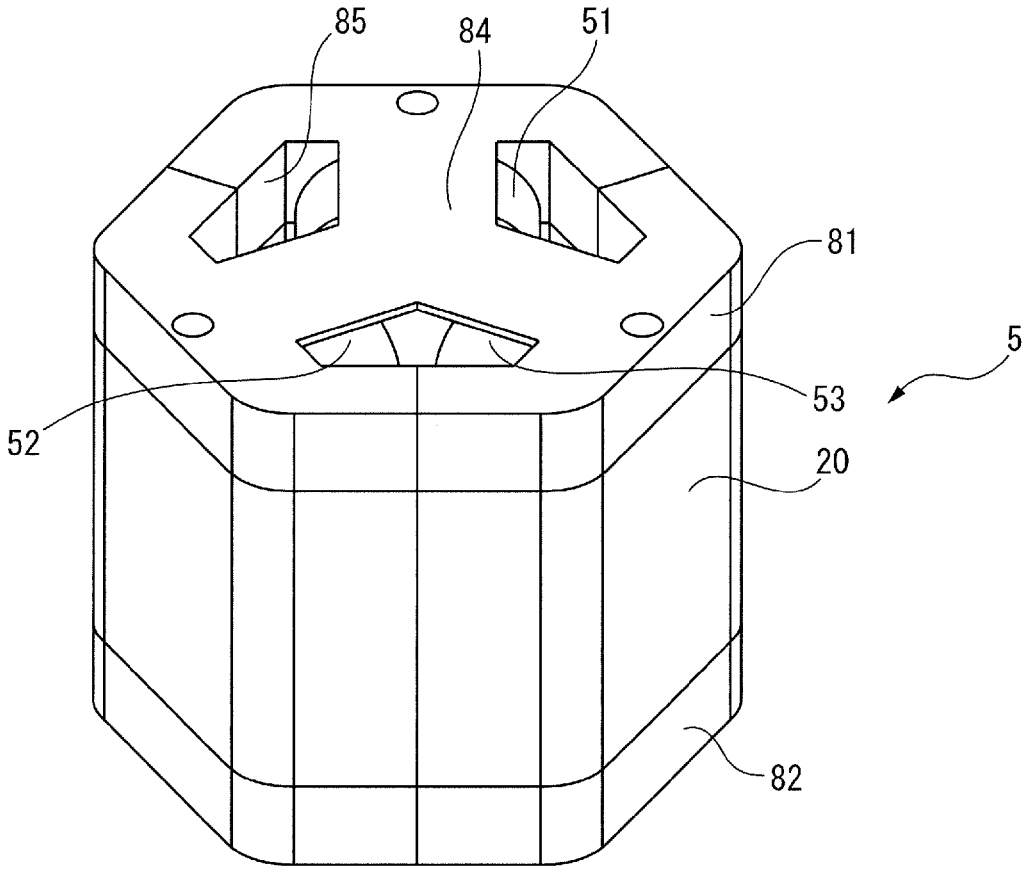
FIG. 5 is a perspective view of an electromagnetic device based on another embodiment of the present invention.

Further, as shown in FIG. 5, which is a perspective view of an electromagnetic device based on another embodiment of the present invention, the through-hole 85 may be at least partially covered. In FIG. 5, the barrier part 81 has a cover part 84. As can be seen from FIG. 5, the cover part 84 has a shape corresponding to that of the iron cores 41 to 43. It is preferable that the cover part 84 be integral with the barrier part 81. For example, the cover part 84 may be formed from a magnetic body, such as a single iron plate.

In such a case, the leakage of the magnetic flux from the coils to the outside of the electromagnetic device can be further prevented. Further, the cover part 84 may entirely cover the end face of the outer peripheral iron core 20. It will be understood that, in such a case, the leakage of the magnetic flux can be further prevented.

Figure 6:
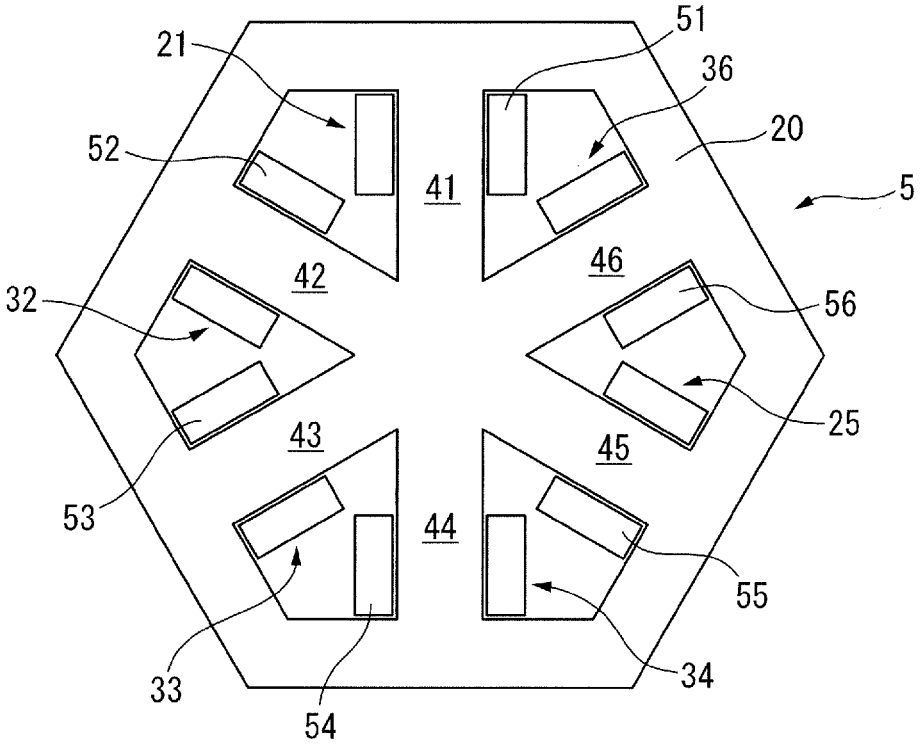
FIG. 6 is a sectional view of an electromagnetic device based on a fourth embodiment of the present invention.

Further, FIG. 6 is a sectional view of an electromagnetic device based on a fourth embodiment of the present invention. In FIG. 6, the electromagnetic device 5 includes the outer peripheral iron core 20 and six iron core coils 31 to 36 which are in contact with or coupled to the inner surface of the outer peripheral iron core 20. The iron core coils 31 to 36 respectively include iron cores 41 to 46, and coils 51 to 56 wound around the iron cores 41 to 46. As can be seen from the drawing, the iron core coils 31 to 36 are spaced at equal intervals in the circumferential direction of the outer peripheral iron core 20.

As seen above, the electromagnetic device 5 may have iron core coils the number of which is a multiple of 3. In this instance, it will be understood that the electromagnetic device 5 can be used as a three-phase transformer.

Figure 7:
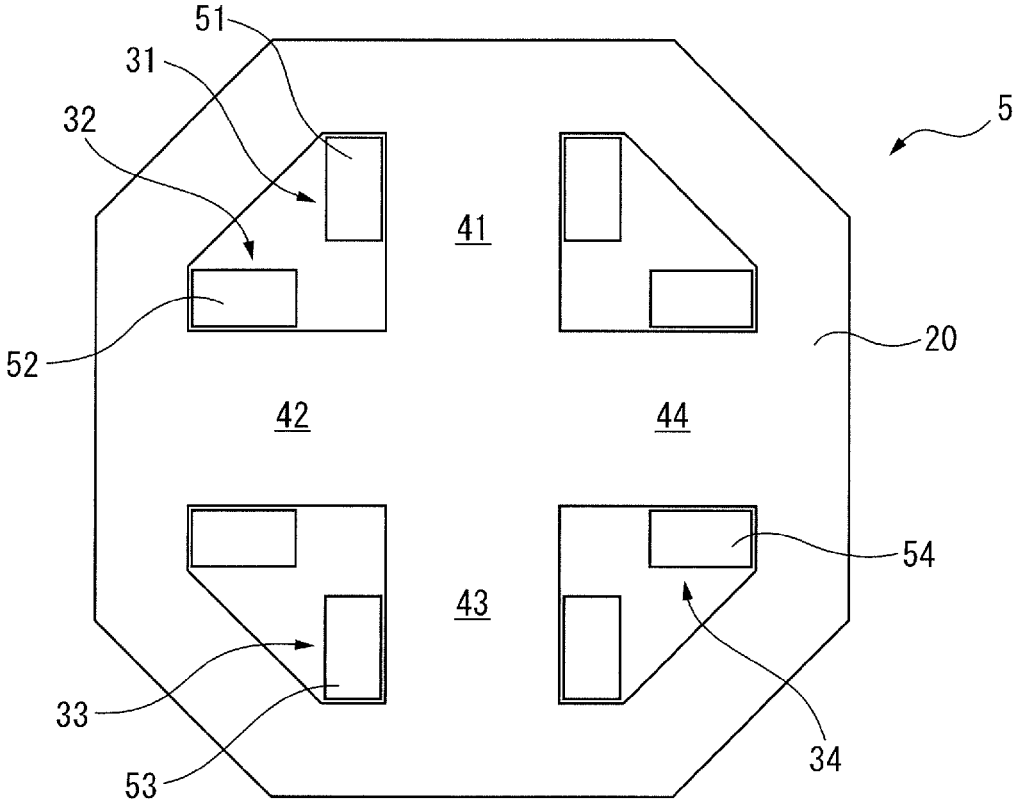
FIG. 7 is a sectional view of an electromagnetic device based on a fifth embodiment of the present invention.

Further, FIG. 7 is a sectional view of an electromagnetic device based on a fifth embodiment of the present invention. In FIG. 7, the electromagnetic device 5 includes the outer peripheral iron core 20, and four iron core coils 31 to 34 which are in contact with or coupled to the inner surface of the outer peripheral iron core 20. The iron core coils 31 to 34 have a configuration substantially similar to the aforementioned configuration, and are spaced at equal intervals in the circumferential direction of the outer peripheral iron core 20.

As seen above, the electromagnetic device 5 may include iron core coils the number of which is an even number not less than 4. In this instance, it will be understood that the electromagnetic device 5 can be used as a single-phase transformer. Further, in the cases of FIG. 6 and FIG. 7, the input and output voltages and the rated current can be adjusted by connecting the coils to one another in series or parallel.

Figure 8:
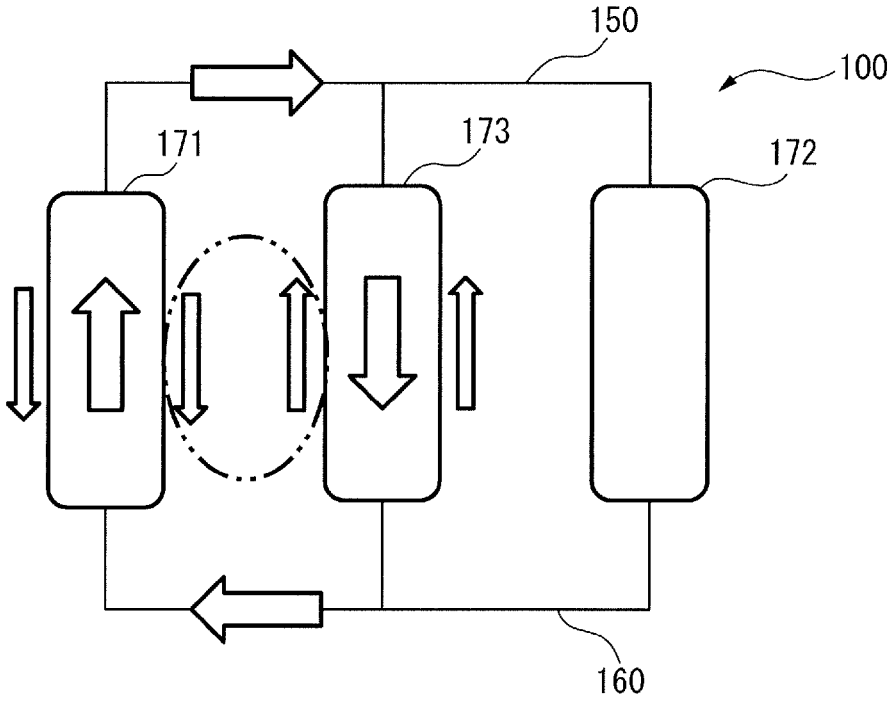
FIG. 8 is a schematic view of a conventional electromagnetic device.

FIG. 8 is a schematic view of a conventional electromagnetic device. In the electromagnetic device 100 shown in FIG. 8, coils 171 to 173 are disposed between two substantially E-shaped iron cores 150 and 160. Thus, the coils 171 to 173 are arranged in parallel with one another.

In FIG. 8, when a magnetic flux passes through two adjacent coils as designated by the wide arrows, magnetic fluxes outside the coils act, as designated by the narrow arrows, on each other so as to cancel each other. This increases the magnetic resistance, and thus, there is a tendency that the direct-current resistance value of the coils of the electromagnetic device 100 shown in FIG. 8 increases, and thus, the loss increases.

Figure 9:
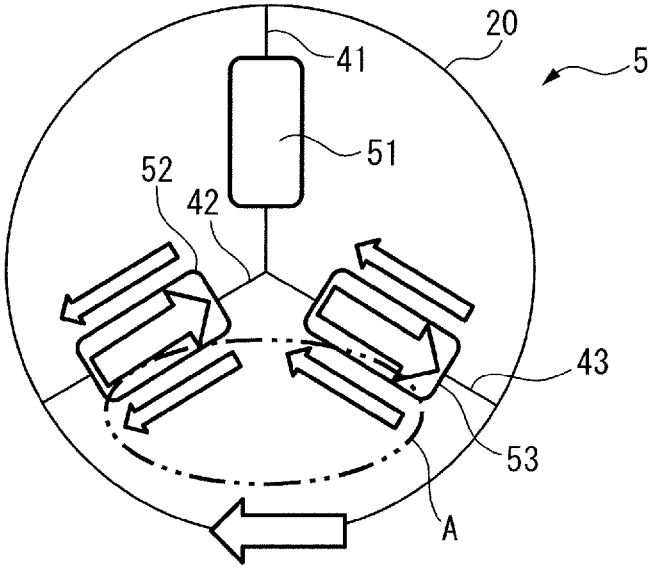
FIG. 9 is a schematic view of an electromagnetic device as shown in FIG. 2A.

FIG. 9 is a schematic view of the electromagnetic device as shown in FIG. 2A. In this instance, the two adjacent coils, e.g., coils 52 and 53, are not parallel to each other, and make an angle of approximately 120°. Thus, even if a magnetic flux passes through the two adjacent coils as designated by the wide arrows, magnetic fluxes outside the coils do not cancel each other as designated by the narrow arrows. Thus, in the electromagnetic device 5 of the present invention, the magnetic resistance does not increase. Thus, there is a tendency that the direct-current resistance values of the coils of the electromagnetic device 5 in the present invention do not largely increase, and the increase in loss is small. It will be obvious that, as the angle between the two adjacent coils increases, the total loss does not needlessly increase without increasing the direct-current resistance values of the coils when the magnetic flux, which passes through the two adjacent coils, forms a closed magnetic path.

Figure 10:
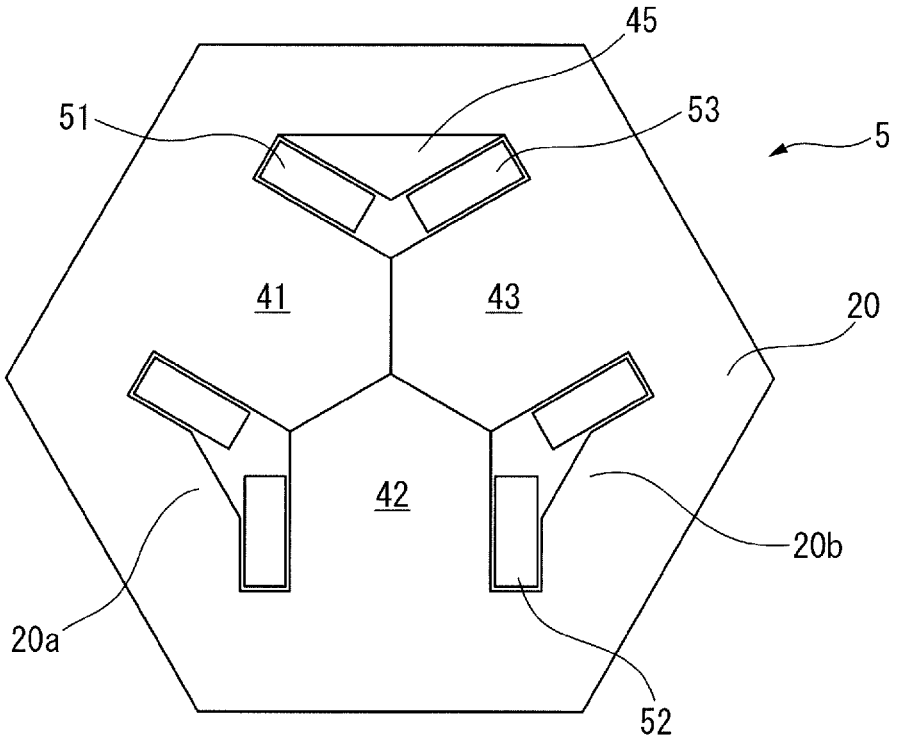
FIG. 10 is a sectional view of an electromagnetic device based on a sixth embodiment of the present invention.

When an iron core is disposed between the two adjacent coils, an action for rectifying the flow of the magnetic fluxes occurring outside the coils is exerted, and accordingly, the direct-current resistance values of the coils can be further prevented from increasing. Thus, it is preferable to dispose an additional iron core in, e.g., area A shown in FIG. 9. FIG. 10 is a sectional view of an electromagnetic device based on a sixth embodiment of the present invention. In FIG. 10, an additional iron core 45 having a section formed like an isosceles triangle is disposed at a location corresponding to area A of FIG. 9. As illustrated, the sides of the cross-sectional surface of the additional iron core 45, which include a vertex angle, are larger than the thickness of the coils 51 and 53.

In FIG. 10, the coils 51 and 53 are in contact with the inner surface of the outer peripheral iron core 20. Thus, the coils 51 and 53 are surrounded by iron cores 41 and 43, the outer peripheral iron core 20, and the additional iron core 45. In other words, three sides of each of the cross-sectional surfaces of the coils 51 and 53 are adjacent to the iron cores 41 and 43, the outer peripheral iron core 20, and the additional iron core 45. In such a case, it will be understood that the aforementioned effect is high.

Further, in FIG. 10, protrusions 20*a* and 20*b* project radially inward from the inner surface of the outer peripheral iron core 20. The protrusions 20*a* and 20*b* respectively project between the coils 51 and 52 and between the coils 52 and 53. The cross-sectional surfaces of the protrusions 20*a* and 20*b* are formed like a substantial isosceles trapezoid, and the protrusions 20*a* and 20*b* are partially in contact with the outer surfaces of the coils 51 and 53.

As can be seen from FIG. 10, the protrusion 20*a* is in contact with the outer surfaces of the coils 51 and 52. The same is substantially true in the protrusion 20*b*. Thus, in this instance, two sides of the cross-sectional surface of each of the coils 51 and 53 are fully in contact with the corresponding iron cores 41 and 43 and the outer peripheral iron core 20, and one side of the cross-sectional surface of each of the coils 51 and 53 is partially in contact with the corresponding protrusions 20*a* and 20*b*. In this instance, it will be understood that an effect substantially similar to the aforementioned effect can be obtained. Note that there may be minute clearances between the coils and the additional iron core 45 or the protrusion parts 20*a* and 20*b*.

In the electromagnetic device 5 shown in FIG. 10, the additional iron core 45 may be disposed in all areas between the coils 51 to 53. Alternatively, in the electromagnetic device 5 shown in FIG. 10, protrusions similar to the aforementioned protrusions may be formed in all areas between the coils 51 to 53.

Figure 11:
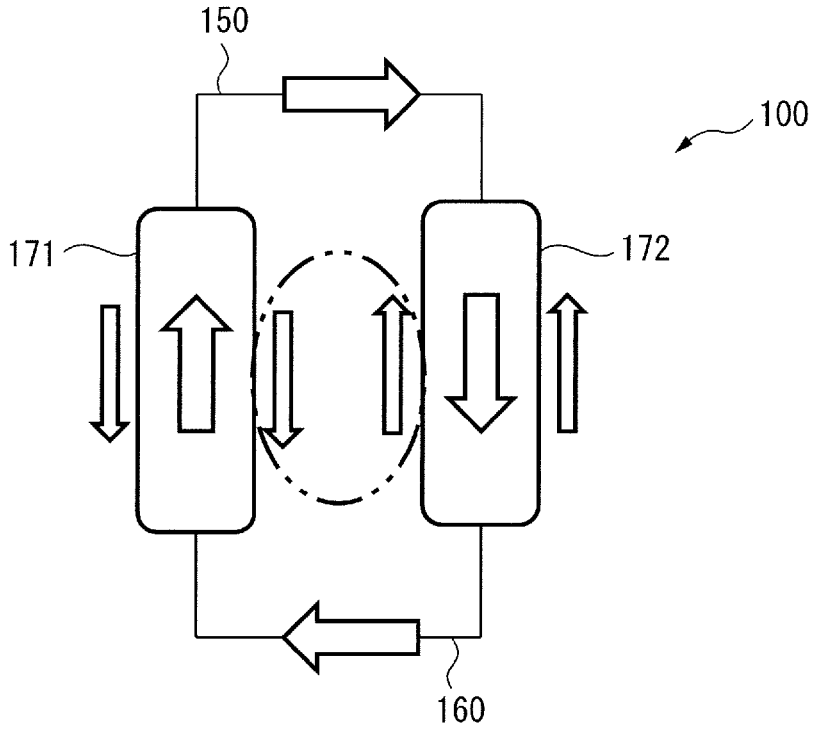
FIG. 11 is another schematic view of a conventional electromagnetic device.

FIG. 11 is a schematic view of a conventional electromagnetic device. In the electromagnetic device 100 shown in FIG. 11, coils 171 and 172 are disposed between two substantially C-shaped iron cores 150 and 160. Thus, the coils 171 and 172 are arranged in parallel with each other.

In FIG. 11, when a magnetic flux passes through the two adjacent coils as designated by the wide arrows, magnetic fluxes outside the coils act, as designated by the narrow arrows, on each other so as to cancel each other. This increases the magnetic resistance, and thus, there is a tendency that the direct-current resistance values of the coils of the electromagnetic device 100 shown in FIG. 11 increase, and thus, the loss increases.

Figure 12:
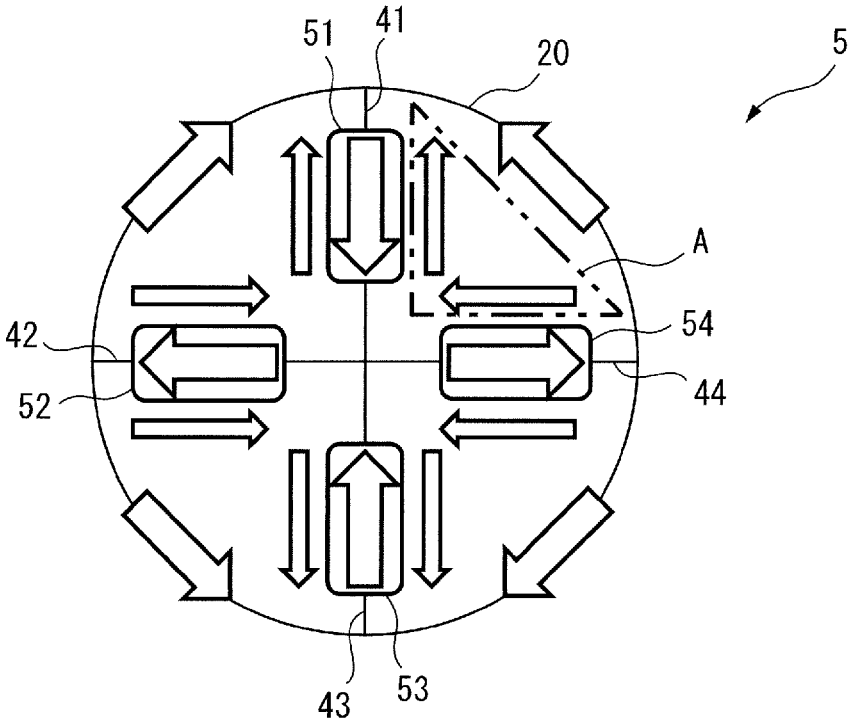
FIG. 12 is a schematic view of an electromagnetic device as shown in FIG. 7.

FIG. 12 is a schematic view of the electromagnetic device as shown in FIG. 7. In this instance, the two adjacent coils, e.g., coils 52 and 53, are not parallel to each other, and make an angle of approximately 90°. Thus, even if the magnetic flux passes through the two adjacent coils as designated by the wide arrows, magnetic fluxes outside the coils do not cancel each other as designated by the narrow arrows. Thus, in the electromagnetic device 5 of the present invention, the magnetic resistance does not increase. Thus, there is a tendency that the direct-current resistance values of the coils of the electromagnetic device 5 in the present invention do not largely increase, and the increase in loss is small. It will be obvious that, as the angle between the two adjacent coils increases, the total loss does not needlessly increase without increasing the direct-current resistance values of the coils when the magnetic flux, which passes through the two adjacent coils, forms a closed magnetic path.

Figure 13:
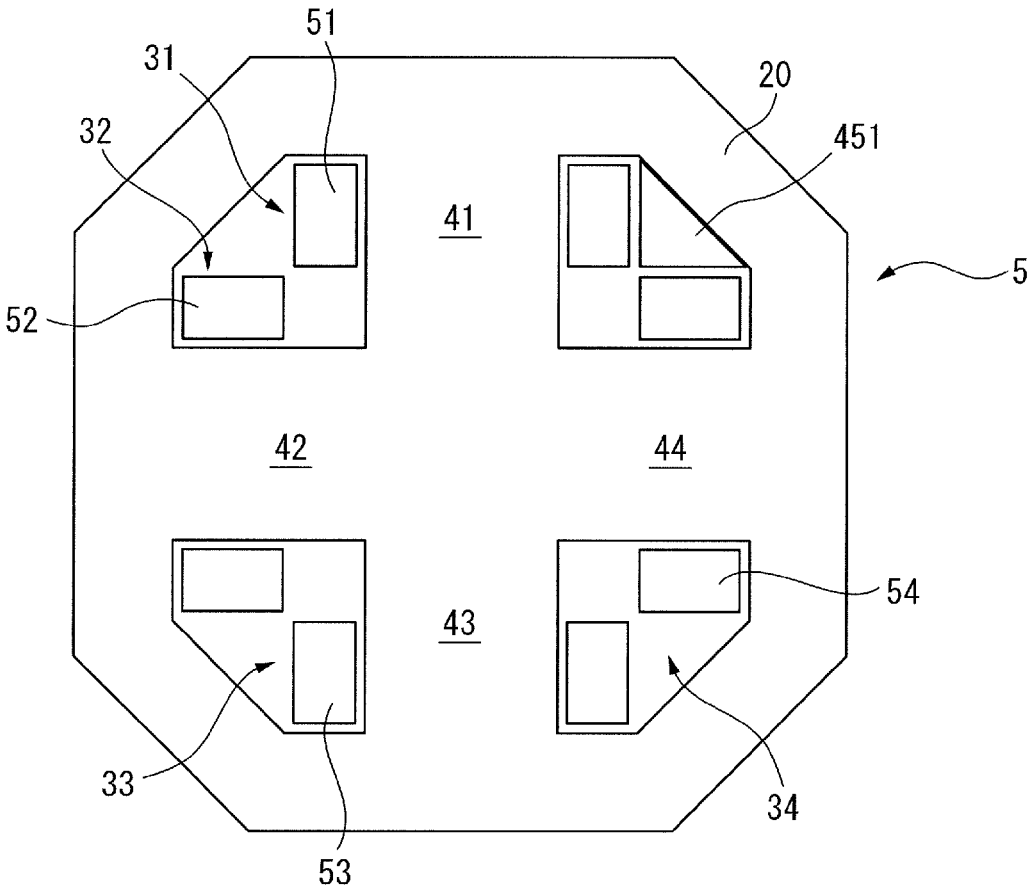
FIG. 13 is a sectional view of an electromagnetic device based on a seventh embodiment of the present invention.

When an iron core is disposed between the two adjacent coils, an action for rectifying the flow of the magnetic fluxes occurring outside the coils is exerted, and accordingly, an increase in the direct-current resistance values of the coils can be further prevented. Thus, it is preferable to dispose an additional iron core in, e.g., area A shown in FIG. 12 of FIG. 12. FIG. 13 is a sectional view of an electromagnetic device based on a sixth embodiment of the present invention. In FIG. 13, an additional iron core 45' having a section formed like an isosceles triangle is disposed at a location corresponding to area A. As illustrated, the sides of the cross-sectional surface of the additional iron core 45', which include a vertex angle, are substantially equal to the thickness of the coils 51 and 54.

In FIG. 13, the coils 51 and 54 are in contact with the inner surface of the outer peripheral iron core 20. Thus, the coils 51 and 54 are surrounded by iron cores 41 and 44, the outer peripheral iron core 20, and the additional iron core 45'. In other words, three sides of the cross-sectional surface of each of the coils 51 and 53 are adjacent to the corresponding iron cores 41 and 43, the outer peripheral iron core 20, and the additional iron core 45'. In such a case, it will be understood that the aforementioned effect is high.

Note that there may be minute clearances between the coils and the additional iron core 45'. In the electromagnetic device 5 shown in FIG. 13, the additional iron core 45' may be disposed in all areas between the coils 51 and 54.

Figure 14:
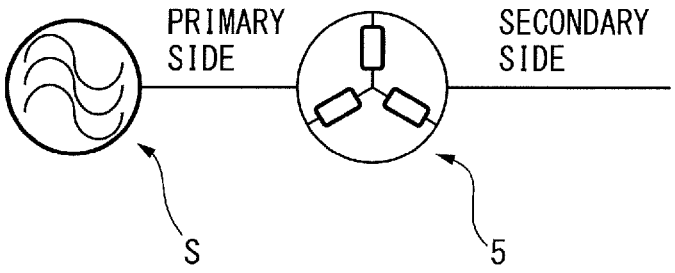
FIG. 14 is a view of the use of an electromagnetic device based on the present invention.
Figure 15:
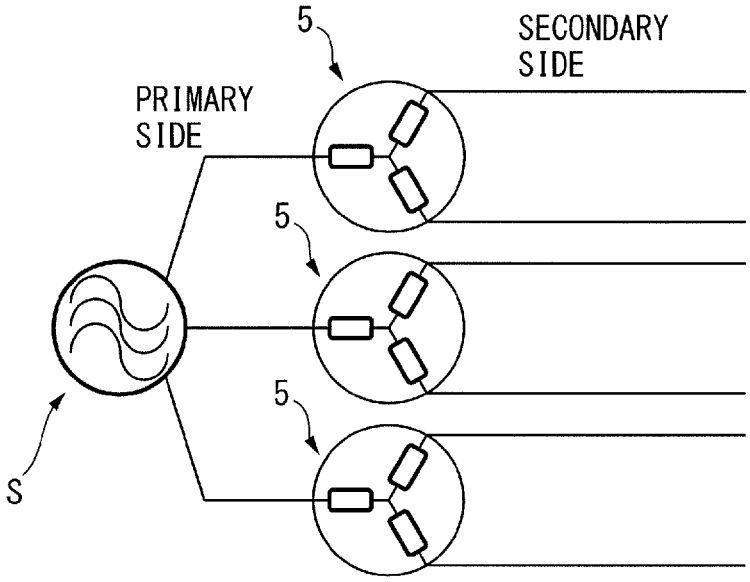
FIG. 15 is another view of the use of an electromagnetic device based on the present invention.

Further, FIG. 14 and FIG. 15 are views of an electromagnetic device based on the present invention. When a primary coil and a secondary coil are wound around each iron core of the electromagnetic device 5, the electromagnetic device 5 is disposed directly downstream of an alternating-current power source S as shown in FIG. 14. Alternatively, when the primary coil is wound around only one phase of the electromagnetic device 5, three electromagnetic devices 5 may be disposed downstream of the alternating-current power source S as shown in FIG. 15.

Figure 16:
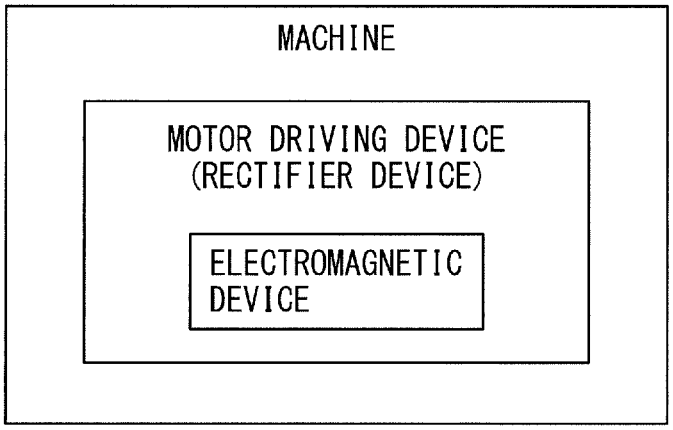
FIG. 16 is a view of a motor driving device, etc., including an electromagnetic device of the present invention.

Further, FIG. 16 is a view of a motor driving device, etc., including an electromagnetic device of the present invention. In FIG. 16, the electromagnetic device 5 is used in a motor driving device. Further, a machine or an apparatus includes such a motor driving device. Alternatively, the electromagnetic device 5 may be provided in a rectifier device.

In such a case, it will be understood that a motor driving device, a rectifier device, a machine, etc., which include the electromagnetic device 5, can be easily provided. Further, appropriately combining some of the aforementioned embodiments is included in the scope of the present invention.

Contents of Disclosure

According to a first aspect, there is provided an electromagnetic device including an outer peripheral iron core, and at least three iron core coils which are in contact with or coupled to the inner surface of the outer peripheral iron core. The at least three iron core coils each include an iron core, and at least one of a primary coil and a secondary coil, which are wound around the iron core. The at least three iron core coils are arranged on a circumference of a circle, and the iron core of one iron core coil of the at least three iron core coils is in contact with the iron cores of the other iron core coils adjacent to the one iron core coil.

According to a second aspect, in the electromagnetic device according to the first aspect, the iron cores of the at least three iron core coils are each comprised of a plurality of iron core portions.

According to a third aspect, in the electromagnetic device according to the first or second aspect, at least two or all of the iron cores of the at least three iron core coils are connected to one another.

According to a fourth aspect, in the electromagnetic device according any of the first to third aspects, the outer peripheral iron core is comprised of a plurality of outer peripheral iron core portions.

According to a fifth aspect, the electromagnetic device according to any of the first to fourth aspects further includes a barrier part for circumferentially covering a protruding portion of each coil, which projects from an end face of the outer peripheral iron core in a stacking direction of the outer peripheral iron core.

According to a sixth aspect, the electromagnetic device according to the fifth aspect further has a cover part provided so as to at least partially cover a hollow portion of the outer peripheral iron core.

According to a seventh aspect, in the electromagnetic device according any of the first to sixth aspects, the number of the at least three iron core coils is a multiple of 3.

According to an eighth aspect, in the electromagnetic device according to any of the first to sixth aspects, the number of the at least three iron core coils is an even number not less than 4.

According to a ninth aspect, in the electromagnetic device according to any of the first to eighth aspects, three sides of the cross-sectional surface of the primary coil or the secondary coil, which is perpendicular to the axial cross-sectional surface of the electromagnetic device, are at least partially adjacent to the corresponding iron core.

According to a tenth aspect, in the electromagnetic device according to any of the first to ninth aspects, the electromagnetic device is a transformer.

According to an eleventh aspect, in the electromagnetic device according to the first to ninth aspects, the electromagnetic device is a reactor.

According to a twelfth aspect, there is provided a motor driving device to which the electromagnetic device according to any of the first to ninth aspects is applied.

According to a thirteenth aspect, there is provided a machine to which the motor driving device according to the twelfth aspect is applied.

According to a fourteenth aspect, there is provided a rectifier device to which the electromagnetic device according to any of the first to ninth aspects is applied.

Effects of the Aspects

In the first aspect, the iron core coils are disposed inside the outer peripheral iron core and the leakage flux from the coils to the periphery can be reduced without providing a shield plate. Further, in a three-phase electromagnetic device, the magnetic path lengths of the three phases are structurally equal, and accordingly, design and production can be easily performed. Further, when the electromagnetic device is used as a transformer, the ratio of the primary input voltage to the secondary output voltage is fixed, and accordingly, control windings are not necessary. Thus, an increase in the size of the electromagnetic device can be avoided.

In the second aspect, attaching the coils can be easily performed, and accordingly, the assembly property of the electromagnetic device can be improved.

In the third aspect, the number of components can be reduced.

In the fourth aspect, attaching the coils can be easily performed, and accordingly, the assembly property of the electromagnetic device can be improved. This is advantageous for making, specifically, a large electromagnetic device, e.g., a large transformer.

In the fifth aspect, the magnetic flux occurring from the coils can be prevented from leaking to the outside of the electromagnetic device.

In the sixth aspect, the magnetic flux occurring from the coils can be further prevented from leaking to the outside of the electromagnetic device. The barrier part may have a shape corresponding to the shape of the three iron cores and the outer peripheral iron core. The cover part may have a shape for fully closing the three iron cores and the outer peripheral iron core.

In the seventh aspect, the electromagnetic device can be used as a three-phase transformer or a three-phase reactor.

In the eighth aspect, the electromagnetic device can be used as a single-phase transformer or a single-phase reactor.

In the ninth aspect, the adjacent coils are not parallel to each other, and the coils are further substantially in contact with the iron cores. Thus, a magnetic flux which interrupts the power distribution between the adjacent coils is unlikely to occur. Further, when the two adjacent iron core coils form a closed magnetic path, an increase or decrease in the inductance depending on an increase or decrease in the current is more moderate than a conventional shape, and loss can be further reduced.

In the twelfth to fourteenth aspects, a motor driving device, a machine, and a rectifier device, which have the electromagnetic device, can be easily provided.

The present invention has been described above using exemplary embodiments. However, a person skilled in the art would understand that the aforementioned modifications and various other modifications, omissions, and additions can be made without departing from the scope of the present invention. Any appropriate combination of these embodiments is included in the scope of the present invention.

What is claimed is:

1. An electromagnetic device comprising:

an outer peripheral iron core; and at least three iron core coils which are in contact with the inner surface of the outer peripheral iron core, wherein the at least three iron core coils each include an iron core, and at least one of a primary coil and a secondary coil, which are wound around the iron core, the at least three iron core coils are arranged on a circumference of a circle, and the iron core of one iron core coil of the at least three iron core coils is integral with the iron cores of the other iron core coils adjacent to the one iron core coil, and each of the iron cores of the at least three iron core coils are integrally formed as a single iron core;

each of the iron cores of the at least three iron core coils converge on a center of the outer peripheral iron core;

the outer peripheral iron core is comprised of a plurality of outer peripheral iron core portions and each of radially outside ends of the iron cores of the at least three iron core coils, which are inserted among the outer peripheral iron core portions; and each of the radially outside ends of the iron cores extend to an outer peripheral surface of the outer peripheral iron core.

* * * * *